United States Patent [19]

Koerner et al.

[11] 4,283,191

[45] Aug. 11, 1981

[54] PREPARATION FOR SHRINKPROOFING WOOL

[75] Inventors: Götz Koerner; Friedhelm Nickel; Günter Schmidt, all of Essen, Fed. Rep. of Germany

[73] Assignee: Th. Goldschmidt AG, Essen, Fed. Rep. of Germany

[21] Appl. No.: 131,781

[22] Filed: Mar. 19, 1980

[30] Foreign Application Priority Data

Mar. 23, 1979 [GB] United Kingdom ..... 10341/79

[51] Int. Cl.[3] ..... D06M 3/02

[52] U.S. Cl. ..... 8/128 A; 260/33.25 B; 260/29.2 M; 252/8.8; 252/8.9

[58] Field of Search ..... 252/8.9, 8.8; 8/128 A; 260/33.2 SB, 29.2 M

[56] References Cited

U.S. PATENT DOCUMENTS

| | | | |
|---|---|---|---|
| 2,891,290 | 6/1959 | Hyde et al. | 260/29.2 M |
| 3,140,198 | 7/1964 | Dawson et al. | 252/8.9 |
| 3,832,228 | 8/1974 | Gardiner et al. | 8/128 A |
| 3,876,459 | 4/1975 | Burrill | 8/128 A |
| 3,941,856 | 3/1976 | Creasey et al. | 260/33.2 SB |
| 4,098,572 | 4/1978 | Smith | 8/128 A |
| 4,101,272 | 7/1978 | Guise et al. | 8/128 A |
| 4,105,567 | 8/1978 | Koerner et al. | 252/8.9 |

FOREIGN PATENT DOCUMENTS

| | | |
|---|---|---|
| 594901 | 11/1947 | United Kingdom . |
| 613267 | 11/1948 | United Kingdom . |
| 629329 | 9/1949 | United Kingdom . |
| 746307 | 3/1956 | United Kingdom . |

OTHER PUBLICATIONS

Guise et al., Journ. of Textile Institute, vol. 68, No. 5, 1977, pp. 163–168.

*Primary Examiner*—Joseph L. Schofer
*Assistant Examiner*—Maria Parrish Tungol
*Attorney, Agent, or Firm*—Toren, McGeady and Stanger

[57] ABSTRACT

A preparation for shrinkproofing wool composed of:

(a) 1 to 50 weight percent of organopolysiloxanes, which are built up from ($a_1$) 90 to 99.8 mole percent of units of formula $R_2{}^1SiO$, and ($a_2$) 0.2 to 10 mole percent of units of the formula $R^2SiO_{1.5}$ in which $R^1$ and $R^2$ consist of 0.1 to 10 mole percent of polyoxyalkylene residues and, on the other hand, of 0.03 to 3 mole percent of mercaptoalkyl or mercaptoaryl residues, and/or 0.06 to 6 mole percent of aminoalkyl residues and/or 0.1 to 10 mole percent of anionic groups, which are linked to silicon atoms through carbon atoms, the remaining portion of $R^1$ and $R^2$ groups being methyl groups, up to 10 mole percent of which however may be replaced by alkyl residues of longer chain length, by aryl residues or by hydrogen atoms, while at the same time up to 5 mole percent of the oxygen atoms, which are liked to silicon, may in each case be replaced by two lower alkoxy or hydroxy groups, and (b) 50 to 99 weight percent of water and/or organic solvents. Wool, treated with this preparation, retains its resistance to shrinking even after repeated launderings. The hand of the wool and the hand of knitted and woven fabrics produced from the wool is not affected.

12 Claims, No Drawings

PREPARATION FOR SHRINKPROOFING WOOL

BACKGROUND OF THE INVENTION

1. Field of the Invention

The invention relates to a preparation for shrinkproofing wool.

2. Description of the Prior Art

It is well known that, in the untreated state, wool shrinks and felts when it is laundered in aqueous liquors. In order to counteract this shrinking and felting, chemical treatments have already been recommended, in which the structure of the wool is changed or in which finishes are used, which contain resin that is deposited on and envelopes the wool fiber. However, both processes produce products having a hand which is regarded as unpleasant by the user.

The reduction of the shrinkage of wool on laundering by treatment with organosilicone compounds has also already been recommended. Such processes are described in British Pat. Nos. 594,901, 613,267 and 629,329. In accordance with these processes, the wool is treated with certain silanes.

In British Pat. No. 746,307, a process for preventing shrinkage of wool is described wherein the wool fibers are finished with certain organopolysiloxanes. Admittedly, some degree of shrinkproofness is achieved with this process. However, this effect is not washfast.

In a further series of publications, for example, in German Offenlegungsschriften Nos. 2,242,297, 2,335,751 and 2,523,270, processes for shrinkproofing keratin fibers by the application of organopolysiloxanes are disclosed. An essential characteristic of these processes is the amino group content of these compounds.

For example, the process according to German Offenlegungsschrift No. 2,242,297 is characterized by the fact that, as organopolysiloxanes, those with units of the general formula $$R_nSiO_{\frac{4-n}{2}}$$

are used, in which n has an average value of 1.9 to 2.1 and

R represents an organic residue, which is linked to silicon by a silicon-carbon bond, 0.25 to 50% of the R substituents being monovalent residues, which have fewer than 30 carbon atoms and, at a distance of at least three carbon atoms from the silicon atom, contain at least one imino group and at least one primary or secondary amino group $—NX_2$, in which X is a hydrogen atom, an alkyl group with 1 to 30 carbon atoms or an aryl group, and the remaining R substituents being monovalent hydrocarbon residues, carboxyalkyl residues, or cyanalkyl residues with 1 to 30 carbon atoms, at least 70% of which consist of monovalent hydrocarbon residues with 1 to 18 carbon atoms.

From German Offenlegungsschrift 2,335,751, a process for treating keratin fibers is known, which is characterized by the fact that the organopolysiloxane composition contains the product which is obtained by mixing components (A) and (B) wherein:

(A) is a polydiorganosiloxane with terminal hydroxyl groups linked to silicon atoms and a molecular weight of at least 750, in which at least 50% of the organic substituents of the polydiorganosiloxane are methyl groups and in which the other substituents are monovalent hydrocarbon groups with 2 to 30 carbon atoms and (B) is an organosilane of the general formula $$RSiR'_nX_{3-n}$$

in which

R is a monovalent group composed of carbon, hydrogen, nitrogen, and possibly oxygen, contains at least 2 amino groups and is linked by a silicon-carbon to silicon, R' is an alkyl group or an aryl group, X represents alkoxy groups with 1 to 4 carbon atoms inclusive and n is 0 or 1, and/or a partial hydrolysate and condensate of the organosilane.

In this German Offenlegungsschrift, it is stated that the two components of the mixture should be reacted, if they are to be applied from an aqueous medium.

In practice, however, it is not possible to prepare stable aqueous emulsions from such reaction products. Gel-like reaction products are formed which cannot be converted into an emulsion. They are therefore not suitable for shrink-proofing wool.

If these reaction products are used in the form of organic solutions, the effect achieved is too small for practical purposes. Moreover, after a period of time, a siloxane gel precipitates from the solvent-containing liquor as a result of the action of the moisture of the atmosphere and obstructs the equipment used for treating the wool.

In the "Journal of Textile Institute" 68 (1977), 163 ff., preparations for shrinkproofing wool are described which contain polysiloxanes in which polyether chains are linked to the molecule. These preparations do not produce a satisfactory effect. Moreover, the high temperatures of 120° C. and the long reaction times of 60 minutes which are required for fixing these compounds on the wool fibers, may, in themselves, cause considerable damage to and discoloration of the wool.

Furthermore, from German Offenlegunsschrift No. 1,769,249 a process for treating fiber material, for example, wool, is known in which organosiloxanes, which contain mercaptopropyl groups, are used in the form of an emulsion. With these compounds, however, it is only possible to improve the soil repellency. The compounds are not suitable for making wool shrinkproof. Consequently, these prior art preparations have not provided fully satisfactory means for shrinkproof finishing of wool.

SUMMARY OF THE INVENTION

We have discovered a preparation for shrinkproofing wool, which contains compounds in emulsion form as well as in organic solution, the compounds being suitable for imparting shrinkproof properties to wool, which properties are retained even after repeated laundering in conventional washing machines. The preparations of the present invention may be used alternatively in the various steps of wool processing by different forms of application. At the same time, the treatment of the wool can take place even after dyeing and known treating processes, such as, exhaustion and padding, can be employed.

Moreover, the active ingredient of the preparation of the present invention does not have a disadvantageous effect on the so-called "hand" of the wool or of knitted and woven fabrics prepared from the wool.

More particularly, the preparation of the present invention comprises:

(a) 1 to 50 weight percent of organopolysiloxanes which are formed from ($a_1$) 90 to 99.8 mole percent of units having the formula $$R_2^1SiO;$$

and ($a_2$) 0.2 to 10 mole percent of units having the formula $R^2SiO_{1.5}$ in which $R^1$ and $R^2$ are composed of: 0.1 to 10 mole percent of polyoxyalkylene residues; and substantive groups selected from the group consisting of 0.03 to 3 mole percent of mercaptoalkyl or mercaptoaryl residues, 0.06 to 6 mole percent of aminoalkyl residues, and 0.1 to 10 mole percent of anionic groups, which are linked to silicon atoms through carbon atoms, with the remaining portion of $R^1$ and $R^2$ groups being methyl groups, up to 10 mole percent of which however may be replaced by alkyl residues of longer chain length, by aryl residues or by hydrogen atoms, while at the same time, up to 5 mole percent of the oxygen atoms, which are linked to silicon, may, in each case, be replaced by two lower alkoxy or hydroxy groups; and (b) 50 to 99 weight percent of water, if necessary, emulsifiers and other organic solvents and, if necessary, conventional additives.

Conventional additives are, for example, flame-proofing materials.

DESCRIPTION OF THE PREFERRED EMBODIMENT

The organopolysiloxane backbone, of which the units ($a_1$) and ($a_2$) are formed, represents a slightly to moderately branched siloxane. At the same time, units ($a_1$) and ($a_2$) preferably are distributed statistically in the siloxane molecule.

It is an essential feature of the invention that these organopolysiloxanes have 0.1 to 10 mole percent of polyoxyalkylene residues. In addition, groups which are substantive to wool, are linked to the organopolysiloxane backbone. These wool-substantive groups may be mercaptoalkyl or mercaptoaryl residues, aminoalkyl residues or anionic groups linked to the silicon atoms through carbon atoms.

It is sufficient if, in addition to the polyoxyalkyl residues, only one of the three designated types of wool-substantive groups, for example, 0.3 to 3 mole percent of mercaptoalkyl or mercaptoaryl residues, 0.06 to 6 mole percent of aminoalkyl residues, or 0.1 to 10 mole percent of anionic groups, which are linked to silicon atoms over carbon atoms is present. However, these three different groupings may also be present simultaneously, for example, mercaptoalkyl residues together with aminoalkyl residues or mercaptoalkyl residues with anionic groups. All three different groupings may thus be incorporated simultaneously in the molecule.

The remaining $R^1$ and $R^2$ groups are methyl groups, of which up to 10 mole percent may be replaced by longer-chain alkyl residues or by aryl residues. Examples of such alkyl or aryl residues are the ethyl, propyl, dodecyl or phenyl residues.

As a result of the combination of the polyoxyalkylene residues, linked to the polysiloxane backbone, with one or several of the wool-substantive groups, it is possible to attain the requirements desired of the preparation.

Preferably, the polyoxyalkylene residues correspond to the formula $$[OC_nH_{2n-x}]O-Z$$

which is linked directly through an SiOC bridge or over a bivalent hydrocarbon residue through an SiC bridge to the polysiloxane and in which Z is a hydrogen residue, a monovalent alkyl or aryl residue, an acyl residue or a trimethylsilyl residue, n has a value of 2 to 3 and x has a value of 2 to 80.

Preferably, the polyoxyalkylene residue corresponds to the formula $$-C_3H_6-[OC_2H_4-]_yOY$$

in which

Y is the $$CH_3\overset{\overset{\displaystyle O}{\|}}{C}-$$

or the trimethylsilyl residue, and y has a value of 4 to 20.

If the polyoxyalkylene block contains propylene oxide units as well as ethylene oxide units, then polyoxyalkylene residues with at least 40 mole percent of polyoxyethylene units are preferred.

Preferably, the amount of polyoxyalkylene residues is in the range from about 0.3 to 5 mole percent.

Examples of mercaptoalkyl or mercaptoaryl residues, linked to the polysiloxane backbone, are 2-mercaptoethyl, 3-mercaptopropyl, 3-mercaptoisobutyl or mercaptophenyl residues.

These mercaptoalkyl or mercaptoaryl residues are linked to the organopolysiloxane molecules in an amount of from about 0.03 to 3 mole percent and preferably, from about 0.1 to 1 mole percent. Examples of preferred residues are 3-(2-aminoethyl-)aminopropyl or the 3-aminopropyl residues. Further examples of suitable aminoalkyl residues are the 4-(2-aminoethyl-)aminobutyl residue or the 3-(2-aminoethyl-)-aminoisobutyl residue. These aminoalkyl residues form 0.06 to 6 mole percent of the $R^1$ and $R^2$ residues and the preferred range is 0.2 to 2 mole percent.

Furthermore, anionic groups may be linked to the organopolysiloxane molecule. These anionic groups are linked to the silicon atom through a bivalent hydrocarbon residue. The hydrocarbon chain of the bivalent hydrocarbon residue may be interrupted by oxygen, nitrogen or sulfur atoms. Particularly suitable as anionic groups are:

$$-R^3O_mSO_3^-,\ -R^3O_m\overset{\overset{\displaystyle O}{\|}}{\underset{\underset{\displaystyle X}{|}}{P}}-O^- \text{ or } -R^3COO^-,$$

in which m is 0 or 1, and

X is a —O⁻ residue or the —$OR^4$ group. At the same time, $R^4$ is a hydrogen residue or an alkyl residue with 1 to 4 carbon atoms. These anionic residues may be present in the form of the free acid or they may be completely or partially neutralized.

Examples of such groups are:

$$-(CH_2)_3OSO_3^{\ominus},\ -(CH_2)_3-O-CH_2-\underset{\underset{OH}{|}}{CH}-CH_2-SO_3^{\ominus},$$

$$-(CH_2)_{10}-COO^{\ominus},\ -(CH_2)_2-COO^{\ominus},$$

$$-(CH_2)_3-O-CH_2-\underset{\underset{OH}{|}}{CH}-CH_2-OP(O)(OH)_2$$

From 0.1 to 10 mole percent and preferably from 0.3 to 6 mole percent of the $R^1$ and $R^2$ groups are formed by such anionic groups.

In principle, the inventive preparations may be prepared by two different methods. The organopolysiloxane may be prepared by an emulsion copolymerization in an aqueous phase of the individual components of the reaction, or the reaction may also take place in the form of a co-condensation in a nonaqueous medium.

If the emulsion copolymerization method is selected, the corresponding organo-modified, α,β-polydimethylsiloxanediols can be prepared by conventional procedures from cyclic siloxanes or from mixtures of cyclic siloxanes with organo-modified di-(tri)alkoxysilanes, such as, for example, 3-mercapto-propyl-methyl-diethoxysilane, 3-aminopropyl-methyl-diethoxy-silane or silanes of the formula $$YO[CH_2CH_2O]_y-(CH_2)_3-\overset{\overset{OC_2H_5}{|}}{\underset{\underset{OC_2H_5}{|}}{Si}}-CH_3$$

in the presence of anionic or cationic polymerization catalysts (See, for example, U.S. Pat. No. 2,891,920). These siloxane diols may then be reacted further with polyalkyleneglycol ether modified or -SH or amino group containing trialkoxysilanes and also with silanes having the formula $$H_3C-\overset{\overset{OC_2H_5}{|}}{\underset{\underset{OC_2H_5}{|}}{Si}}-(CH_2)_3-OSO_3^{\ominus}\ .\ \overset{\overset{H}{|}}{\oplus N}-(CH_3)_3$$

through which an anionic group can be introduced into the organopolysiloxane. The synthesis of the organomodified alkoxysilane is conventional and known to those skilled in the art.

When synthesizing the organopolysiloxanes in a nonaqueous phase, it is advisable to start from sulfate ester of an organosilicon alcohol having the formula $$Cl-\overset{\overset{CH_3}{|}}{\underset{\underset{(CH_2)_3}{|}}{Si}}-O$$
$$|$$
$$O-SO_2\ .$$

This starting product, which also contains a potential anionic groups, can be reacted in the presence of an acid acceptor, such as, for example, an amine, with α,β-polydimethylsiloxanediols. These may have the formula $$\left[HO-\overset{\overset{CH_3}{|}}{\underset{\underset{CH_3}{|}}{Si}}-O-\right]_p H$$

wherein p=a whole number >1.

In addition to the anionic groups, the reaction product also contains terminal reactive SiOH groups, which are capable of co-condensing with the alkoxy groups of the silanes modified with polyalkyleneglycol and possibly also with mercaptoalkyl. After the co-condensation, which preferably is carried out at elevated temperatures in the presence of tertiary amines, the solvent is removed by a simple distillation.

Besides this procedure, which is based on the reaction of the described sulfate ester with siloxane diols, the following procedure may also be used.

α,β-polydimethylsiloxanediol is mixed with di-(tri)-alkoxysilanes which contain the functional groups. The two materials are condensed in the usual manner, for example, by the actions of heat in an atmosphere of nitrogen and optionally after the addition of a conventional catalyst, such as, water, organo-tin compounds and/or strong acids. If a portion of the organo-functional di-(tri)-alkoxysilanes is replaced by di-(tri)-chlorosilanes or if the initially described acidic sulfate ester is used, it is generally not necessary to add a catalyst.

The organosiloxanes so prepared, may be converted into the inventive aqueous preparations, by working-in water, if necessary, in the presence of suitable emulsifiers.

Examples of organopolysiloxanes for use in the preparations of the present invention are compounds of the following structure $$\left[\overset{\overset{CH_3}{|}}{\underset{\underset{CH_3}{|}}{Si}}-O-\right]_p \left[\overset{\overset{CH_3}{|}}{\underset{\underset{\underset{\underset{SO_3^{\ominus}\ .\ HN^{\oplus}(C_2H_5)_3}{|}}{O}}{|}}{(CH_2)_3}}{Si}-O-\left[\overset{\overset{CH_3}{|}}{\underset{\underset{CH_3}{|}}{Si}}-O-\right]_p\right]_q \left[\overset{\overset{SiO_{1.5}}{|}}{R^5}\right]_r$$

wherein $R^5$=a mercaptoalkyl residue and/or an aminoalkyl residue and a polyoxyalkylene residue, $$\left[\overset{\overset{CH_3}{|}}{\underset{\underset{CH_3}{|}}{Si}}-O-\right]_p \left[\overset{\overset{CH_3}{|}}{\underset{\underset{\underset{\underset{(OC_2H_4)_xOZ}{|}}{(CH_2)_3}}{|}}{Si}}-O-\left[\overset{\overset{CH_3}{|}}{\underset{\underset{CH_3}{|}}{Si}}-O-\right]_p\right]_q \left[\overset{\overset{SiO_{1.5}}{|}}{R^6}\right]_r$$

wherein $R^6$ is a mercaptoalkyl residue and/or an aminoalkyl residue and/or an anionic group linked to silicon atoms through carbon atoms

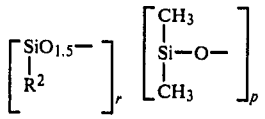

wherein $R^2$ is a mercaptoalkyl residue and/or an aminoalkyl residue and/or anionic groups linked to silicon atoms through carbon atoms and a residue of the formula $-(CH_2)_3-(OC_2H_4)_xOZ$

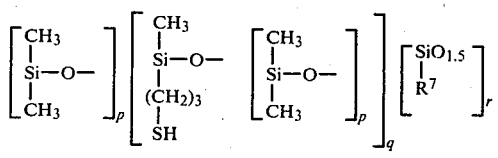

wherein $R^7$ is a polyoxyalkylene residue, possibly an anionic group linked to a silicon atom through a carbon atom, p is a whole number from 5 to 1000, q is a whole number from 1 to 20, and r is a whole number from 1 to 15.

EXAMPLE 1

Into 200 ml of a suitable solvent, such as, methylene chloride, which has been added to a reaction flask, 29.2 g (0.135 moles) of a sulfate ester of an organosilicon alcohol of the formula

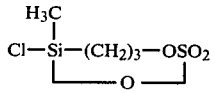

and a mixture of 370.8 g (0.27 moles) of $\alpha,\omega$-polydimethylsiloxanediol (p=18.1) and 30.45 g (0.3 moles) of triethylamine are added dropwise, simultaneously and at room temperature from two dropping funnels. In order to be able to control the reaction better, the reaction components are diluted with methylene chloride to a volume of 500 ml.

After stirring for two hours, the reaction product is mixed with 64.8 g (0.071 moles) of a silane having the formula

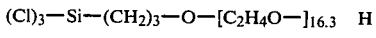

and 7.97 g (0.033 mole HS—) of a slightly condensed partial hydrolysate of 3-mercaptopropyltriethoxysilane with 15 weight percent of hydroxyl groups, heated to 60° C. and stirred for a further two hours.

The partially condensed, partial hydrolysate was obtained by the reaction of 3-mercaptopropyltriethoxysilane with 2% hydrochloric acid in methylene chloride.

Subsequently, the solvent was removed by a simple distillation. The reaction product, which was freed from triethylammonium chloride by a pressure filtration, is a slightly yellow organopolysiloxane of low viscosity, whose $R^1$ and $R^2$ residues are methyl residues of which however 1.35 mole percent are replaced by

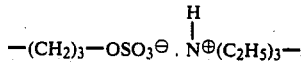

residues, 0.71 mole percent are replaced by

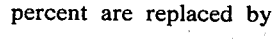

residues, and 0.32 mole percent are replaced by $-(CH_2)_3-SH$ residues.

Simply by stirring in water, aqueous preparations can be prepared from the organopolysiloxane with an active content of 1 to 50 weight percent.

EXAMPLE 2

400 ml of methylene chloride, 223.3 g (0.3 moles) of $\alpha,\omega$-polydimethylsiloxanediol (p=9.6) as well as 61.1 g (0.6 moles) of triethylamine are added to a reaction flask and, while stirring, mixed with 43.3 g (0.2 moles) of a sulfate ester of an organosilicon alcohol formula

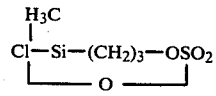

which was dissolved in 200 ml of methylene chloride and added from a dropping funnel. Stirring was subsequently continued at room temperature for two hours and 39.7 g (0.075 moles) of a silane of formula

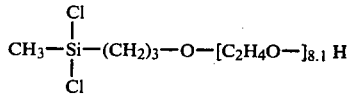

was then added and the temperature raised to 60° C. After stirring for a further two hours, 4.12 g (0.021 moles) of 3-mercaptopropyltrimethoxysilane were added dropwise and the reaction mixture was stirred once again for 60 minutes at 60° C.

The solvent is now distilled off gently and the reaction product freed from triethylammonium chloride by pressure filtration. From the organopolysiloxane, whose $R^1$ and $R^2$ consist of 3.13 mole percent of

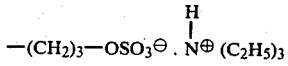

residues, 1.17 mole percent of

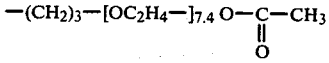

residues, and 0.32 mole percent of $-(CH_2)_3-SH$ residues, the remaining residues being methyl residues, stable preparations containing 1.0 to 50% of siloxane can be prepared simply by stirring in water.

EXAMPLE 3

480 g of water, 3.3 g of didecyldimethylammonium chloride, 1.7 g dioctadecyldimethylammonium chloride, 3.5 g of a betaine of formula $$C_{12}H_{25}CONHCH_2CH_2\overset{\overset{CH_3}{|}}{\underset{\underset{CH_3}{|}}{N}}{}^{\oplus}\ CH_2COO^{\ominus}$$

and 10 g of a 1 molar solution of caustic potash are added to a reaction flask and heated with stirring to 95° C.

By means of a dropping funnel, 136 g (0.459 moles) of octamethylcyclotetrasiloxane and 34.4 g (0.0488 moles) of $$H_3C-\underset{\underset{O}{\|}}{C}-O-[C_2H_4O-]_{7.4}\,(CH_2)_3-\underset{\underset{CH_3}{|}}{Si}-(OCH_3)_2$$

are added and the mixture is stirred vigorously for 1 hour. Subsequently, 2.4 g (0.0122 moles) of 3-mercaptopropyltrimethoxysilane are added dropwise to the emulsion and stirring is continued for a further 30 minutes. The emulsion is then cooled to 40° C. and neutralized by the addition of 12.0 g of a 10% solution of acetic acid.

The finely divided preparation, so prepared, contains an organopolysiloxane, in which the $R^1$ and $R^2$ residues are 1.29 mole percent of $$-(CH_2)_3-[OC_2H_4-]_{7.4}O-\underset{\underset{O}{\|}}{C}-CH_3-$$

and 0.322 mole percent of $-(CH_2)_3-SH$ residues, and the remaining residues are methyl residues.

EXAMPLE 4

Into an emulsifier solution at 95° C., corresponding to that of Example 3, 167 g (0.56 moles) of octamethylcyclotetrasiloxane are added dropwise with vigorous stirring. After a 1-hour stirring phase and a 30 minute waiting phase, 14.0 g (0.015 moles) of $$H_3C-\underset{\underset{O}{\|}}{C}-O-[C_2H_4O-]_{16.1}\,(CH_2)_3-Si-(OCH_3)_3$$

and 2.95 g (0.015 moles) of 3-mercaptopropyltrimethoxysilane are added dropwise and vigorous stirring is continued for an additional 30 minutes. After cooling to 40° C., the solution of caustic potash, which is contained in the emulsion is neutralized by the addition of 12 g of a 10% solution of acetic acid.

The finely divided, aqueous preparation contains an organopolysiloxane, whose $R^1$ and $R^2$ residues are methyl residues, of which however 0.33 mole percent are replaced by $$-(CH_2)_3-[OC_2H_4-]_{16.1}O-\underset{\underset{O}{\|}}{C}-CH_3$$

residues, and 0.33 mole percent are replaced by $-(CH_2)_3-SH$ residues.

EXAMPLE 5

A hot emulsifier solution at 95° C., corresponding to that of Example 3, is stirred vigorously and mixed dropwise with 167 g (0.56 moles) of octamethylcyclotetrasiloxane and 15.95 g (0.03 moles) of $$H_3C-\underset{\underset{O}{\|}}{C}-O-[C_2H_4O-]_{7.4}\,(CH_2)_3-\underset{\underset{CH_3}{|}}{Si}-(OCH_3)_2$$

After the addition, stirring is continued for 1 hour and 6.05 g (0.027 moles) of 3-(aminoethyl)-aminopropyltrimethoxysilane are further added. After stirring for a further 30 minutes, the emulsion is cooled to 40° C. and neutralized by the addition of 16 g of a 10% solution of acetic acid.

The finely divided aqueous preparation contains an organopolysiloxane, in which the $R^1$ and $R^2$ are 0.65 mole percent of $$-(CH_2)_3-O-[C_2H_4O-]_{7.4}O-\underset{\underset{O}{\|}}{C}-CH_3$$

residues and 0.59 mole percent of $-(CH_2)_3-NH-(CH_2)_2-NH_2$ residues, and the remaining residues are methyl residues.

EXAMPLE 6

Not in accordance with the invention

An emulsifier solution is prepared as in Example 3. After heating the solution to 95° C., 167 g (0.56 moles) of octamethylcyclotetrasiloxane are added dropwise from a dropping funnel with vigorous stirring. Stirring is continued for a further 60 minutes and 27.98 g (0.03 moles) of $$H_3C-\underset{\underset{O}{\|}}{C}-O-[C_2H_4O-]_{16.1}\,(CH_2)_3-Si-(OCH_3)_3$$

are then added dropwise and stirred once again for 30 minutes. The emulsion is then cooled to 40° C. and neutralized by the addition of 12 g of a 10% solution of acetic acid. The finely divided aqueous preparation contains an organopolysiloxane whose $R^1$ and $R^2$ residues are methyl residues, of which, however, 0.66 mole percent are replaced by $$-(CH_2)_3-[OC_2H_4-]_{16.1}\,O-\underset{\underset{O}{\|}}{C}-CH_3\text{ - residues.}$$

EXAMPLE 7

A reaction flask is filled with 380 g of water and 3 g of dodecylbenzenesulfonic acid and heated with stirring to 95° C.

In order to prepare the organopolysiloxane (a), consisting of units ($a_1$) and ($a_2$), 167.00 (0.56 moles) of octamethylcyclotetrasiloxane, 5.61 g (0.015 moles) of $$(H_5C_2O)_2-\underset{\underset{CH_3}{|}}{Si}-(CH_2)_3-OSO_3^{\ominus}\,.\,HN^{\oplus}(C_2H_5)_3,$$

27.98 g (0.03 moles) of $$H_3C-\underset{\underset{O}{\|}}{C}-O-[C_2H_4O-]_{16.1}(CH_2)_3-Si-(OCH_3)_3$$

and 2.95 g (0.015 moles) 3-mercaptopropyltrimethoxysilane are added to the emulsifier solution from a dropping funnel. When the addition of the various components has been completed, vigorous stirring is continued for 60 minutes. The emulsion is then cooled to 40° C. and the acid obtained is neutralized by the addition of 11 g of a 1 molar solution of caustic potash.

The finely divided aqueous preparation contains an organopolysiloxane, in which the $R^1$ and $R^2$ residues consist of 0.33 mole percent of $$-(CH_2)_3-O-SO_3^{\ominus}\,.\,\overset{\overset{H}{|}}{N}^{\oplus}(C_2H_5)_3$$

residues, 0.66 mole percent of $$-(CH_2)_3-[OC_2H_4-]_{16.1}O-\underset{\underset{O}{\|}}{C}-CH_3$$

residues, and 0.33 mole percent of $-(CH_2)_3-SH$ residues; and the remaining residues are methyl residues.

EXAMPLE 8

(Comparison example corresponding to German Offenlegungsschrift 2,365,977)

The following components were mixed: Polydimethylsiloxane with terminal

| | |
|---|---|
| ≡Si—OH—groups and a molecular weight of 45 000 (3000 cSt) | 90 parts by weight |
| $(CH_3O)_3Si(CH_2)_3NH(CH_2)_2NH_2$ | 5 parts by weight |
| partial condensate of $H_3CSi(OCH_3)_3$ | 5 parts by weight |

An amount of this mixture required for the preparation of the impregnating solution, is dissolved in toluene and diluted to the concentration desired for the application.

Application Example

A material, knitted from a fine wool, is treated with the preparations described in Examples 1 to 8 so that, after a simply drying of the impregnated fabric at 90° C., the add-on of solids is 1%. In the case of the inventive Examples 1 to 5 and 7, drying may, however, also take place at room temperature, because the preparations described in these examples, contain organopolysiloxanes which cure completely at this temperature. After a storage period of 24 hours at 20° C., finished as well as untreated material was washed in a domestic washing machine at 40° C. with the addition of 5 g/l of Perox needle soap and 2 g/l soda. Between washings, the material was dried in a tumble dryer. After 20 launderings, each of 20 minutes, the area felting shrinkage was calculated using the following formula $$\text{area felting shrinkage} = \%L + \%W - \frac{\%L \times \%W}{100}$$

%L = percentage shrinkage in length,
%W = percentage shrinkage in width.

The following values were determined:

| Sample | Area Felting Shrinkage |
|---|---|
| Untreated material | 44.0% |
| Example 1 | 4.2% |
| Example 2 | 2.6% |
| Example 3 | 2.8% |
| Example 4 | 3.2% |
| Example 5 | 3.0% |
| Example 6 (not in accordance with the invention) | 39.0% |
| Example 7 | 2.4% |
| Example 8 (not in accordance with the invention) | 6.5% |

In contrast to the treated materials, the unfinished sample exhibited a strongly felted surface. After laundering, moreover, the hand of the treated samples was significantly softer than the hand of the untreated materials and was similar to the hand before laundering.

What is claimed is:

1. A preparation for shrinkproofing wool comprising:

(a) 1 to 50 weight percent of organopolysiloxanes consisting of ($a_1$) 90 to 99.8 mole percent of units having the formula $R_2^1SiO$, and ($a_2$) 0.2 to 10 mole percent of units having the formula $R^2SiO_{1.5}$ in which $R^1$ and $R^2$ are composed of 0.1 to 10 mole percent of polyoxyalkylene substituents and a wool substantive substituent selected from the group consisting of 0.03 to 3 mole percent of mercaptoalkyl or mercaptoaryl substituents;

0.06 to 6 mole percent of aminoalkyl substituents, and 0.1 to 10 mole percent of anionic groups, which are linked to silicon atoms through carbon atoms, the remaining portions of $R^1$ and $R^2$ groups being methyl groups, up to 10 mole percent of which may be replaced by alkyl substituents of longer chain length, by aryl substituents or by hydrogen atoms, while at the same time up to 5 mole percent of the oxygen atoms, which are linked to silicon, may in each case be replaced by two lower alkoxy or hydroxy terminal groups, and (b) 50 to 99 weight percent of water.

2. The preparation of claim 1 wherein the polyoxyalkylene substituents correspond to the formula $[OC_nH_{2n}-]_x\,O-Z$ which are linked directly through an SiOC bridge or over a divalent hydrocarbon substituents to the polysiloxane, and in which Z is a hydrogen substituents, a monovalent alkyl or aryl residue, an acyl residue or a trimethylsilyl residue, n has a value of 2 to 3 and x has a value of 2 to 80.

3. The preparation of claim 2 wherein the polyoxyalkylene substituents correspond to the formula $$[-C_3H_6-OC_2H_4-]_y\,OY$$

in which

Y is $$CH_3\overset{\overset{\displaystyle O}{\|}}{C}-$$

or the trimethylsilyl substituents and y has a value of 4 to 20.

4. The preparation of claim 1, 2 or 3, wherein the mercaptoalkyl substituents contain a linear or a branched alkylene substituents with 1 to 4 carbon atoms.

5. The preparation of claim 1, 2, or 3, wherein the aminoalkyl substituents is 3-(2-aminoethyl-)aminopropyl, 3-aminopropyl, 4-(2-aminoethyl-)aminobutyl substituents or the 3-(2-aminoethyl-)aminoisobutyl substituents.

6. The preparation of claim 1, 2, or 3 wherein the anionic groups correspond to the formula $$-R^3O_mSO_3^-,\ -R^3O_m\underset{\underset{\displaystyle X}{|}}{\overset{\overset{\displaystyle O}{\|}}{P}}-O^-\ \text{or}\ -R^3COO^-$$

which are present in the form of the acid or are completely or partially neutralized, wherein $R^3$ is a divalent hydrocarbon substituent, which may be interrupted by oxygen, nitrogen or sulfur atoms, X is a $-O^-$ or the $-OR^4$ group, in which $R^4$ is a hydrogen substituent or an alkyl substituent with 1 to 4 carbon atoms and m is 0 or 1.

7. The preparation of claims 1, 2, or 3 wherein $R^1$ and $R^2$ are composed of 0.3 to 5 mole percent of polyoxyalkylene substituents and a wool substantive residue selected from the group consisting of 0.1 to 1 mole percent of mercaptoalkyl or mercaptoaryl substituents, 0.2 to 2 mole percent of aminoalkyl substituents, and 0.3 to 6 mole percent of anionic groups, which are linked to silicon atoms over carbon atoms, and the remaining portions of $R^1$ and $R^2$ groups are methyl groups up to 10 mole percent of which may be replaced by longer-chain alkyl substituents or aryl substituents.

8. The preparation of claim 1, 2, or 3 wherein the polyoxyalkylene block contains propylene oxides units and ethylene oxide units and the polyoxyethylene substituents contain at least about 40 mole percent polyoxyethylene.

9. The preparation of claim 1, 2, or 3 wherein the mercaptoalkyl or mercaptoaryl residues are 2-mercaptoethyl, 3-mercaptopropyl, 3-mercaptoisobutyl or mercaptophenyl substituents.

10. The preparation of claim 1, 2, or 3 wherein the anionic groups are $$-(CH_2)_3OSO_3^{\ominus},\ -(CH_2)_3-O-CH_2-\underset{\underset{\displaystyle OH}{|}}{CH}-CH_2-SO_3^{\ominus},$$

$$-(CH_2)_{10}-COO^{\ominus},\ -(CH_2)_2-COO^{\ominus},\ \text{or}$$

$$-(CH_2)_3-O-CH_2-\underset{\underset{\displaystyle OH}{|}}{CH}-CH_2-OP\,(O)\,(OH)_2.$$

11. In a method for shrinkproofing wool wherein wool is treated with a shrinkproofing preparation, the improvement which comprises the shrinkproofing preparation being the preparation of claim 1, 2, or 3.

12. Wool treated by the method of claim 11.

* * * * *